US007550933B1

(12) United States Patent
Yang

(10) Patent No.: US 7,550,933 B1
(45) Date of Patent: Jun. 23, 2009

(54) OFFLINE CONTROL CIRCUIT OF LED DRIVER TO CONTROL THE MAXIMUM VOLTAGE AND THE MAXIMUM CURRENT OF LEDS

(75) Inventor: Ta-Yung Yang, Milpitas, CA (US)

(73) Assignee: System General Corp., Taipei (TW)

( * ) Notice: Subject to any disclaimer, the term of this patent is extended or adjusted under 35 U.S.C. 154(b) by 0 days.

(21) Appl. No.: 11/968,851

(22) Filed: Jan. 3, 2008

(51) Int. Cl.
*G05F 1/00* (2006.01)

(52) U.S. Cl. ..... 315/308; 315/291; 315/247; 315/324; 315/224

(58) Field of Classification Search ..... 315/185 S, 315/200 A, 247, 246, 224, 225, 291, 307–326
See application file for complete search history.

(56) References Cited

U.S. PATENT DOCUMENTS

2002/0154524 A1* 10/2002 Yamanaka et al. ..... 363/59
2008/0116818 A1* 5/2008 Shteynberg et al. ..... 315/192
2008/0129220 A1* 6/2008 Shteynberg et al. ..... 315/291

* cited by examiner

*Primary Examiner*—Tuyet Vo
(74) *Attorney, Agent, or Firm*—Banger Shia

(57) ABSTRACT

An offline control circuit of LED driver controls the maximum voltage and the maximum current of a plurality of LEDs. A switching circuit generates a plurality of LED currents through a transformer. A voltage-feedback circuit generates a voltage loop signal in response to the voltage across the LEDs. A current-feedback circuit senses a plurality of LED currents for generating a current loop signal in response the maximum current of the LEDs. A buffer circuit generates a feedback signal in accordance with the voltage loop signal and the current loop signal. The feedback signal is coupled to the switching circuit through an optical-coupler for controlling the maximum voltage and the maximum current of the LEDs.

9 Claims, 6 Drawing Sheets

OFFLINE CONTROL CIRCUIT OF LED DRIVER TO CONTROL THE MAXIMUM VOLTAGE AND THE MAXIMUM CURRENT OF LEDS

BACKGROUND OF THE INVENTION

1. Field of the Invention

The present invention relates to a LED (light emission diode) driver, and more particularly to an offline control circuit to control the maximum voltage and the maximum current of the LEDs.

2. Description of Related Art

The LED driver is utilized to control the brightness of the LED in accordance with its characteristic. The LED driver is also utilized to control the current that flow through the LED. A higher current increases intensity of the bright of the LED, but decreases the life of the LED. FIG. 1 shows a traditional offline circuit of the LED driver. The output voltage $V_O$ of the LED driver is adjusted to provide a current $I_{LED}$ through a resistor 79 to LEDs 71 to 75. The current $I_{LED}$ is shown as, $$I_{LED} = \frac{V_O - V_{F71} - \ldots - V_{F75}}{R_{79}} \quad (1)$$

wherein the $V_{F71}$ to $V_{F75}$ are the forward voltage of the LEDs 71 to 75 respectively.

The drawback of the LED driver shown in FIG. 1 is the variation of the current $I_{LED}$. The current $I_{LED}$ is changed in response to the change of the forward voltage of $V_{F71}$ to $V_{F75}$. The forward voltages of $V_{F71}$ to $V_{F75}$ are not the constant due to the variation of the production and operating temperature. Hence, the maximum voltage and the maximum current of the LEDs 71 to 75, 81 to 85 may overload and decrease the life of the LEDs 71 to 75, 81 to 85.

SUMMARY OF THE INVENTION

An objective of the invention is to provide an offline control circuit to control the maximum voltage and the maximum current of the LEDs.

The present invention provides an offline control circuit for LED driver. The offline control circuit includes a switching circuit, a voltage-feedback circuit, a current-feedback circuit and a buffer circuit. The switching circuit generates a plurality of LED currents through a transformer to control the intensity of the LEDs. The LEDs are connected in series and parallel. The voltage-feedback circuit generates a voltage loop signal in response to the voltage across the LEDs. The current-feedback circuit is coupled to the LEDs to sense currents of the LEDs for generating a current loop signal in response the maximum current of the LEDs. The buffer circuit generates a feedback signal in accordance with the voltage loop signal and the current loop signal. The feedback signal is coupled to the switching circuit through an optical-coupler for controlling the maximum voltage and the maximum current of LEDs.

BRIEF DESCRIPTION OF THE DRAWINGS

The accompanying drawings are included to provide a further understanding of the present invention, and are incorporated in and constitute a part of this specification. The drawings illustrate embodiments of the present invention and, together with the description, serve to explain the principles of the present invention. In the drawings.

DESCRIPTION OF THE PREFERRED EMBODIMENTS

Figure 1:
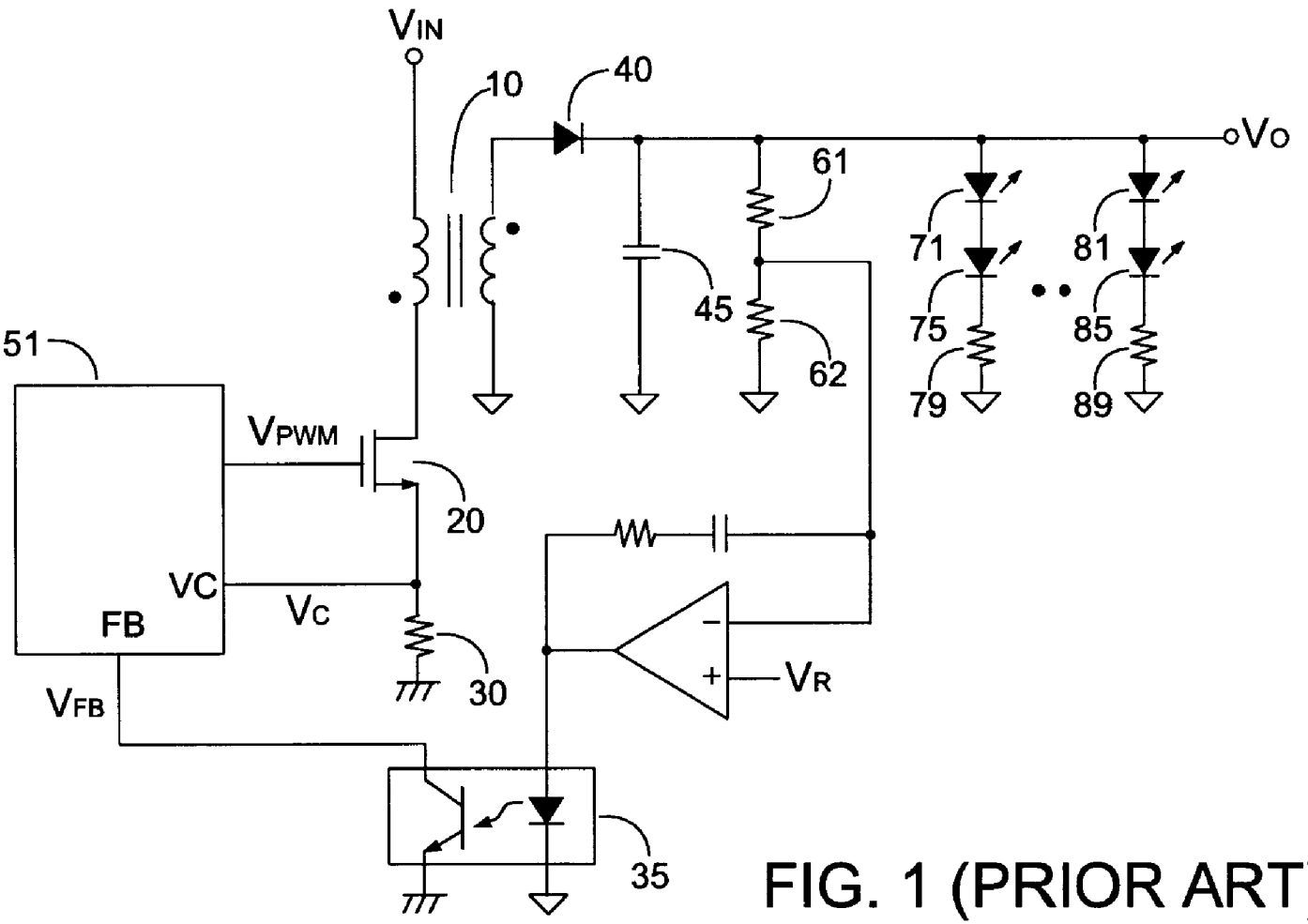
FIG. 1 (PRIOR ART)
FIG. 1 shows a circuit diagram of a conventional offline LED driver.
Figure 2:
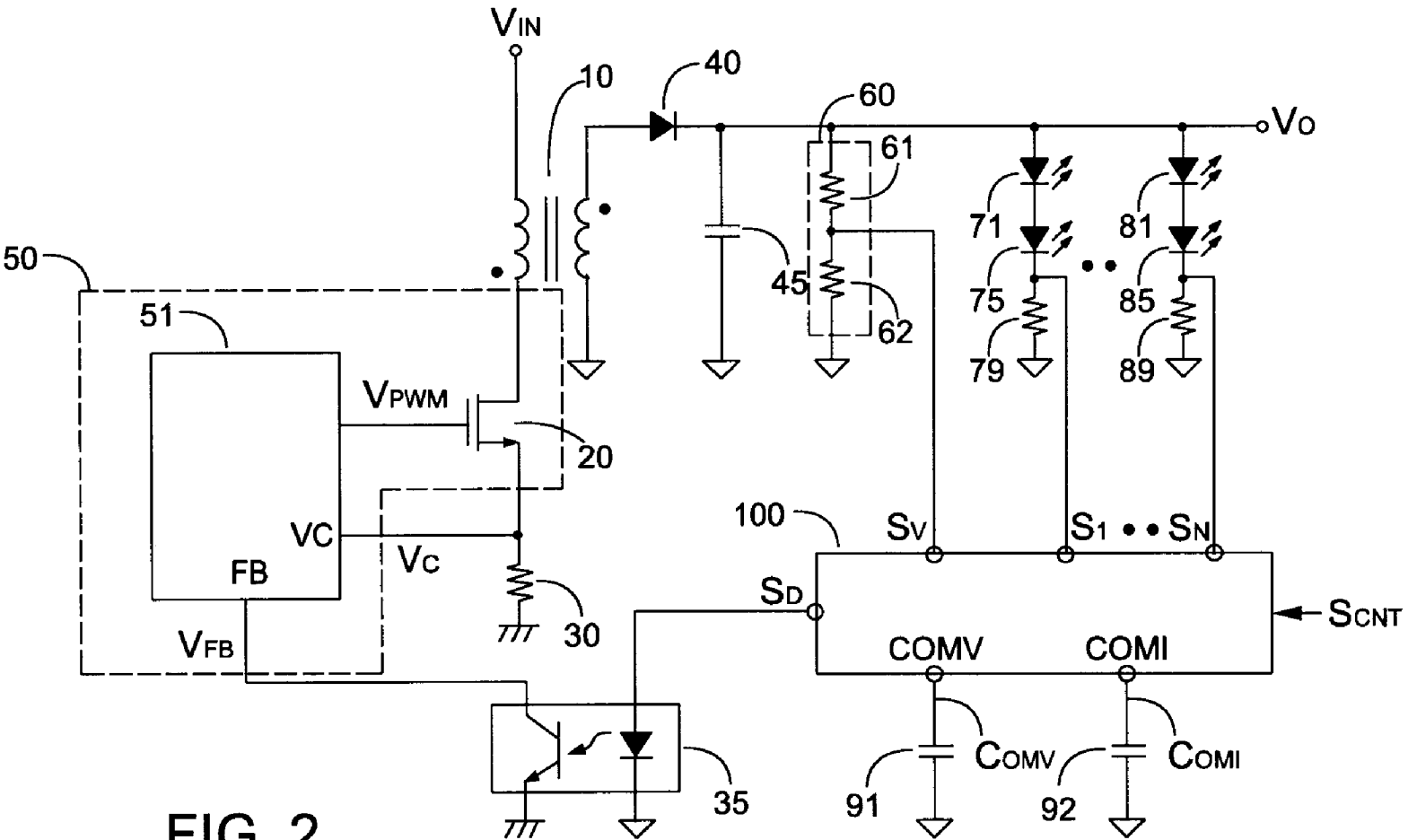
FIG. 2 shows a circuit diagram of an offline control circuit of a LED driver in accordance with present invention.

FIG. 2 shows a preferred embodiment of an offline control circuit of a LED driver in accordance with present invention. The offline control circuit includes a switching circuit 50, a voltage divider 60 and a feedback circuit 100. LEDs 71 to 75 and a resistor 79 are connected in series. LEDs 81 to 85 and a resistor 89 are connected in series, and then connected with the LEDs 71 to 75 in parallel. An output voltage $V_O$ is supplied to the LEDs 71 to 75 and 81 to 85. A plurality of LED currents flowing through resistors 79, 89 generate a plurality of current-feedback signals $S_1$ to $S_N$. The voltage divider 60 has at least two resistors 61 and 62 and detects the output voltage $V_O$ to generate a voltage-feedback signal $S_V$. The feedback circuit 100 is coupled to detect current-feedback signals $S_1$ to $S_N$ and the voltage-feedback signal $S_V$ for generating a feedback signal $S_D$ and regulating the LED currents. A control signal $S_{CNT}$ is coupled to the feedback circuit 100 to control the intensity of the LEDs 71 to 75 and 81 to 85.

The switching circuit 50 including a switching controller 51 and a power transistor 20 generates the LEDs current through a transformer 10. A rectifier 40 and a capacitor 45 couple to the transformer 10 and produce the output voltage $V_O$ in response to the switching of the transformer 10. The switching controller 50 generates a switching signal $V_{PWM}$ in accordance with a feedback voltage $V_{FB}$ and a switching current signal $V_C$. The feedback voltage $V_{FB}$ is produced by the feedback signal $S_D$ through an optical coupler 35. The switching signal $V_{PWM}$ is coupled to switch the transformer 10 through the power transistor 20. A resistor 30 is connected to the power transistor 20 and coupled to the transformer 10. The resistor 30 detects the switching current of the transformer 10 for generating the switching current signal $V_C$.

Figure 3:
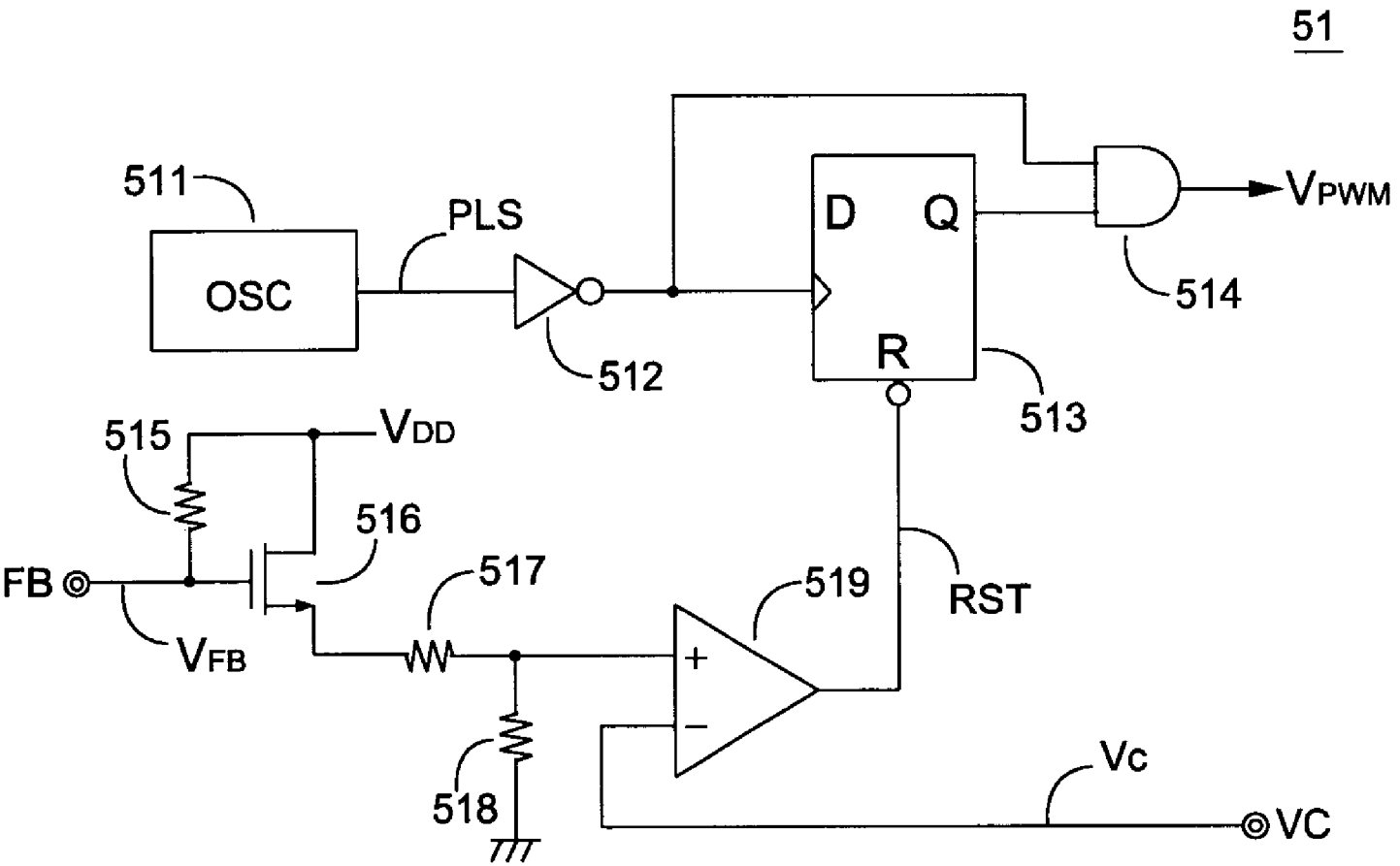
FIG. 3 shows a circuit diagram of a switching controller according to the present invention.

FIG. 3 shows the circuit diagram of the switching controller 51 according to the present invention. The switching controller 51 includes an oscillator (OSC) 511, an inverter 512, a flip-flop 513, an AND gate 514, a comparator 519, a pull high resistor 515, a level-shift transistor 516 and two resistor 517, 518. An oscillator (OSC) 511 generates a pulse signal PLS coupled to the flip-flop 513 via the inverter 512 and enables the flip-flop 513. The output Q of the flip-flop 513 and the output of the inverter 512 are connected to the AND gate 514 to enable the switching signal $V_{PWM}$. The feedback voltage $V_{FB}$ is transmitted to the level-shift transistor 516. The pull high resistor 515 is connected to the level-shift transistor 516 for the bias. The resistor 517 and 518 form a voltage divider and is connected to the level-shift transistor 516 for generating an attenuation signal. The attenuation signal is transmitted to an input of the comparator 519. Another input of the comparator 519 receives the switching current signal $V_C$. The comparator 519 compares the attenuation signal with the switching current signal $V_C$ and generates a reset signal RST to disable the switching signal $V_{PWM}$ through the flip-flop 513.

Figure 4:
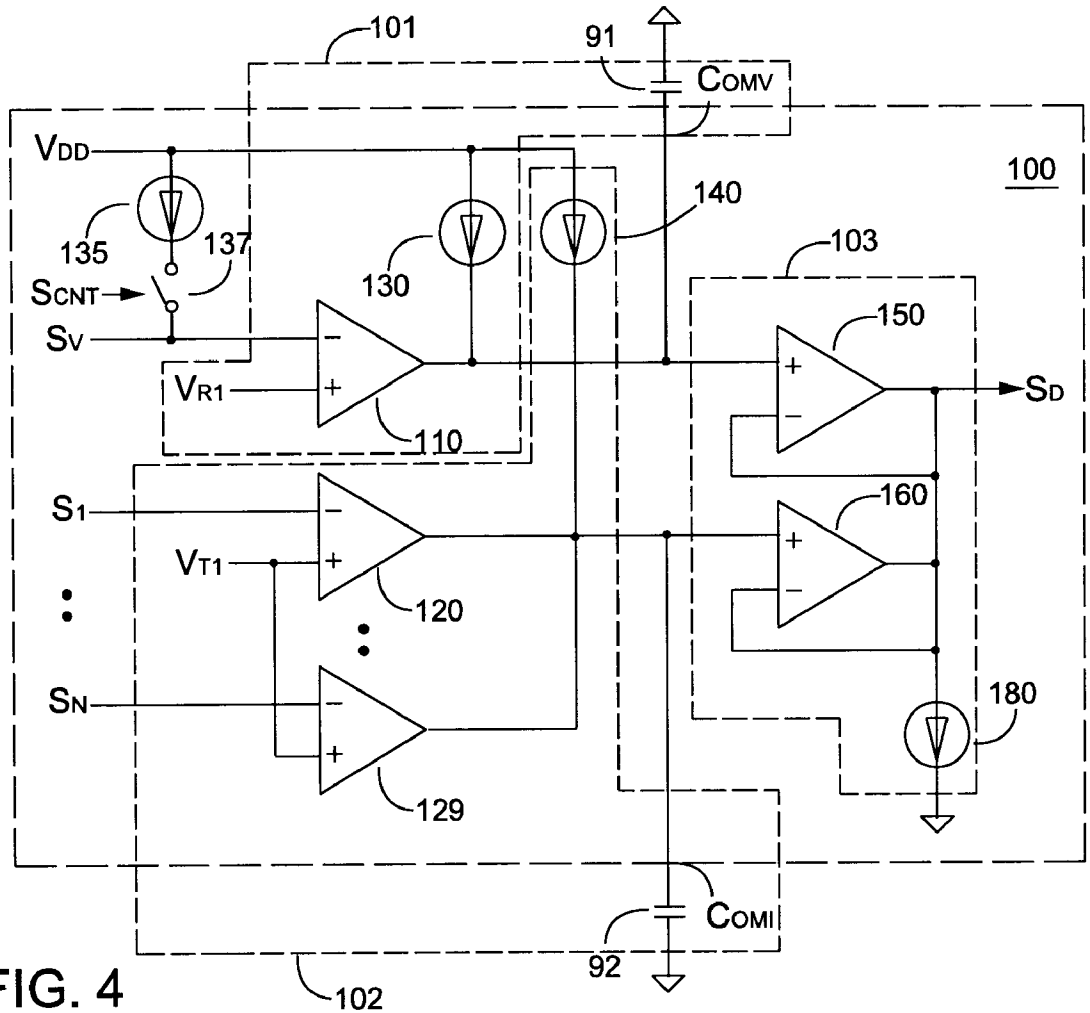
FIG. 4 shows a circuit diagram of a feedback circuit of the offline control circuit in accordance with present invention.

FIG. 4 shows a circuit diagram of the feedback circuit 100 of the offline control circuit in accordance with present invention. A voltage-feedback circuit 101 includes an operational amplifier 110, a current source 130 and a first capacitor 91. The operational amplifier 110 has a reference voltage $V_{R1}$ comparing with the voltage-feedback signal $S_V$ to generate a voltage loop signal $C_{OMV}$. The first capacitor 91 is coupled from the output of the operational amplifier 110 to the ground for frequency compensation. The operational amplifier 110 is a trans-conductance operational amplifier.

A current-feedback circuit 102 has operational amplifiers 120 to 129, a current source 140 and a second capacitor 92. The positive input of operational amplifiers 120 to 129 has a current threshold $V_{T1}$. The negative input of operational amplifiers 120 to 129 sense the current-feedback signals $S_1$h $S_N$ respectively. The operational amplifiers 120 to 129 generate a current loop signal $C_{OMI}$ in response the maximum current of LEDs. The second capacitor 92 is coupled from outputs of the operational amplifiers 120 to 129 to the ground for the frequency compensation. The operational amplifiers 120 to 129 are trans-conductance operational amplifier and parallel connected.

A buffer circuit 103 includes two buffer amplifiers 150, 160 and a current source 180. The buffer amplifier 150 and the buffer amplifier 160 are connected in parallel for generating the feedback signal $S_D$ in accordance with the voltage loop signal $C_{OMV}$ and the current loop signal $C_{OMI}$. The feedback signal $S_D$ is coupled to the switching circuit 50 through the optical-coupler 35 for controlling the maximum voltage and the maximum current of the LEDs.

A current source 135 is coupled to the voltage divider 60 through a switch 137 and receives the voltage-feedback signal $S_V$. The control signal $S_{CNT}$ controls the switch 137. Therefore, a control current is generated in response to the control signal $S_{CNT}$. The current of the control current is determined by the current source 135. The control current is coupled to the voltage divider 60 to control the voltage across LEDs.

$$V_O = \frac{R_{61} + R_{62}}{R_{62}} \times V_{R1} \tag{1}$$

$$V_O = \frac{R_{61} + R_{62}}{R_{62}} \times \left(V_{R1} - I_{135} \times \frac{R_{61} \times R_{62}}{R_{61} + R_{62}}\right) \tag{2}$$

Where $R_{61}$ and $R_{62}$ are the resistance of the resistors 61 and 62 respectively; and $I_{135}$ is the current of the current source 135.

Figure 5:
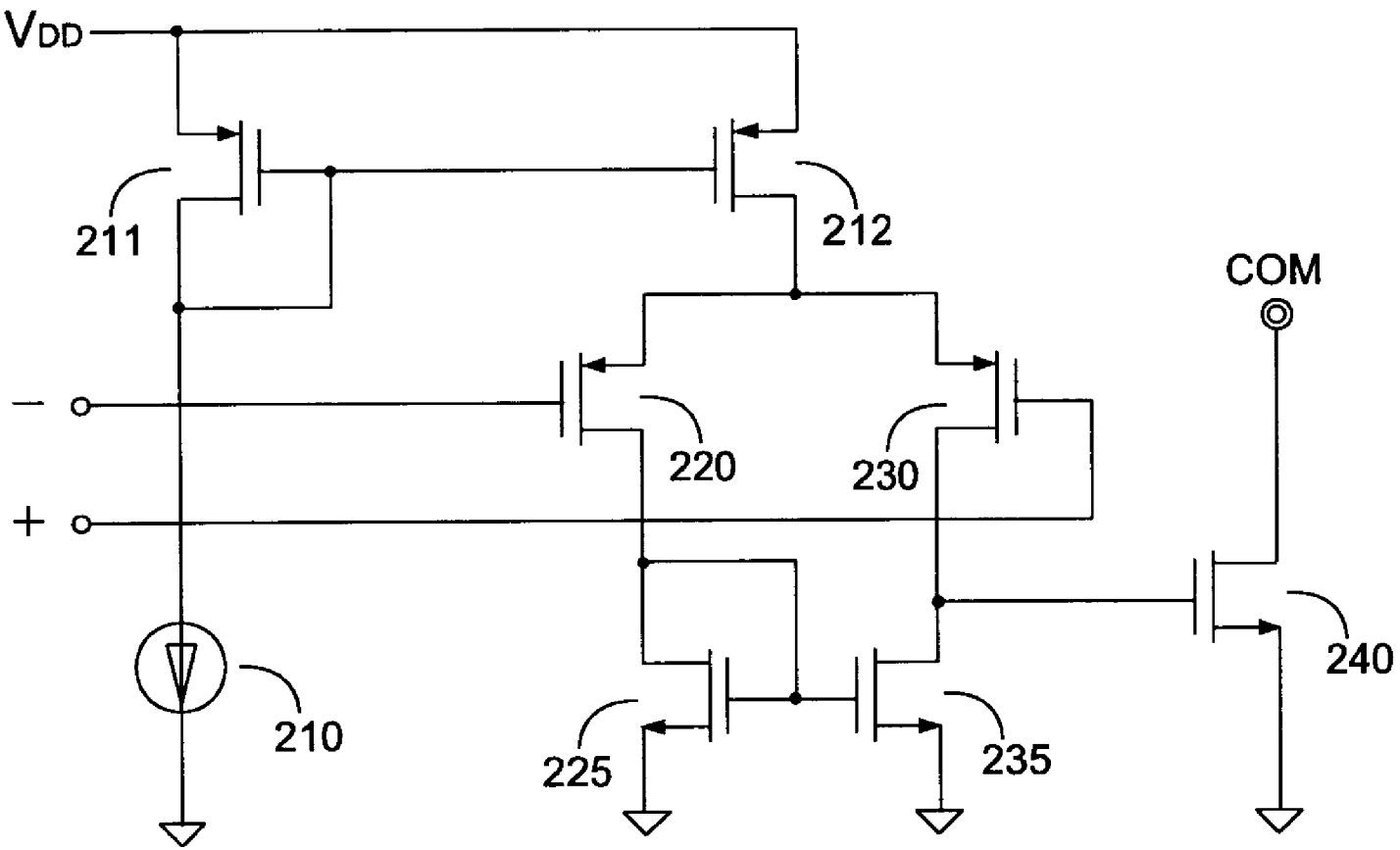
FIG. 5 shows a circuit diagram of a trans-conductance operational amplifier according to the present invention.

FIG. 5 shows an example circuit for the trans-conductance operational amplifiers 110, 120 to 129. The circuit comprises a plurality of transistors 211, 212, 220, 225, 230, 235, 240 and a current source 210. The transistor 211 has a gate that is coupled to the transistor 212 and the current source 210, a drain that is coupled to the current source 210, and a source that is coupled to a voltage source $V_{DD}$ and the transistor 212. The transistor 212 has a gate that is coupled to the transistor 211, a drain that is coupled to the transistors 220 and 230, and a source that is coupled to the voltage source $V_{DD}$ and the transistor 211. The transistor 220 has a gate that is coupled to an inverting input terminal of the amplifier, a drain that is coupled to the transistors 225 and 235, and a source that is coupled to the transistor 212. The transistor 230 has a gate that is coupled to a non-inverting input terminal of the amplifier, a drain that is coupled to the transistors 235 and 240, and a source that is coupled to the transistor 212. The transistor 225 has a gate that is coupled to the transistors 235 and 220, a drain that is coupled to the transistor 220, and a source that is coupled to the ground. The transistor 235 has a gate that is coupled to the transistors 225 and 220, a drain that is coupled to the transistor 240, and a source that is coupled to the ground. The transistor 240 has a gate that is coupled to the transistors 230 and 235, a drain that is coupled to a common terminal COM of the amplifier, and a source that is coupled to the ground.

Figure 6:
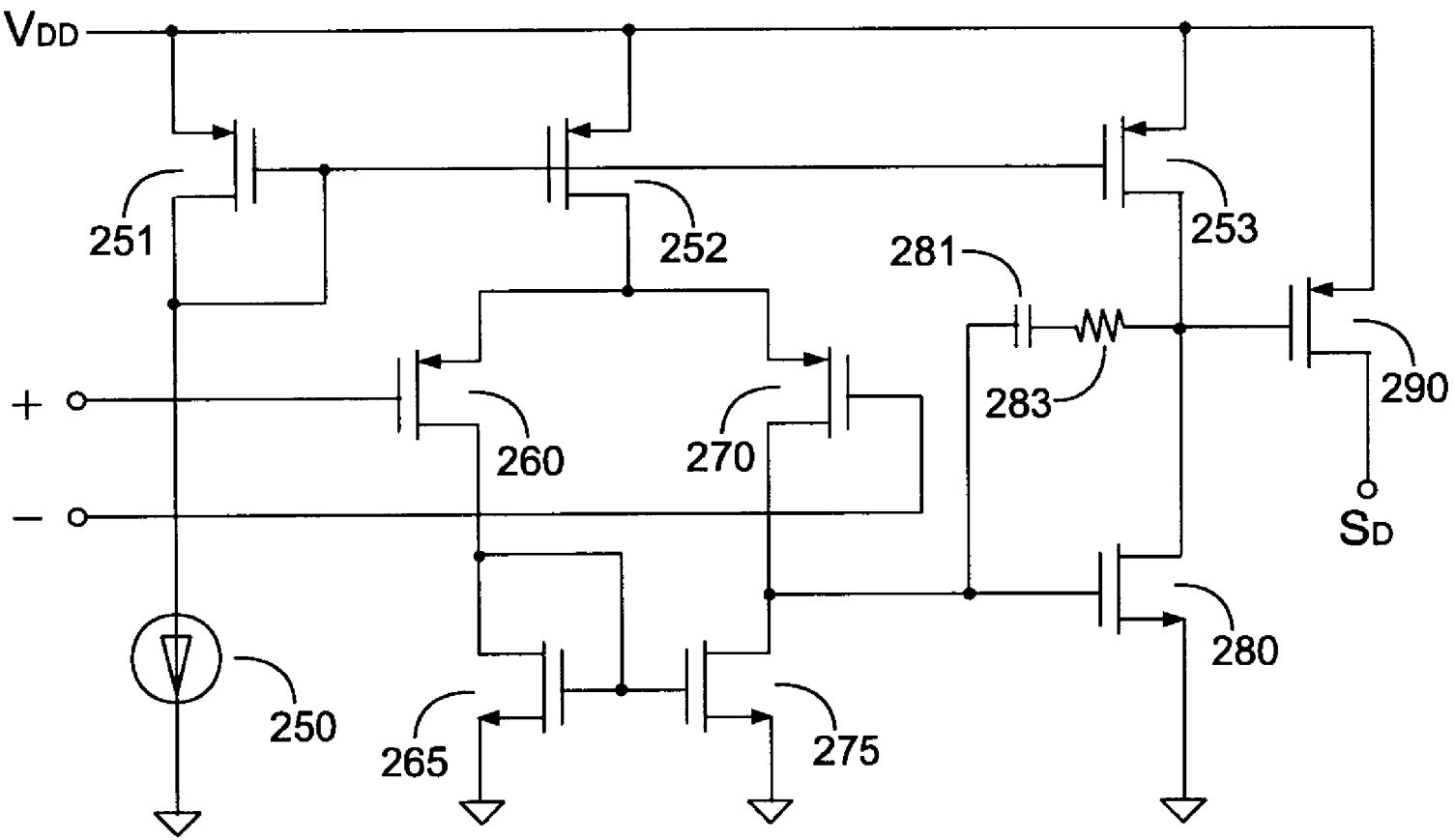
FIG. 6 shows a circuit diagram of another trans-conductance buffer amplifier according to the present invention.

FIG. 6 shows another example circuit for trans-conductance buffer amplifiers 150 and 160. The circuit comprises a plurality of transistors 251, 252, 253, 260, 265, 270, 275, 280, 290 and a current source 250, a capacitor 281 and a resistor 283 connected in series. The transistor 251 has a gate that is coupled to the transistors 252, 253 and the current source 250, a drain that is coupled to the current source 250, and a source that is coupled to the voltage source $V_{DD}$ and the transistors 252, 253, 290. The transistor 252 has a gate that is coupled to the transistor 251, a drain that is coupled to the transistors 260 and 270, and a source that is coupled to the voltage source $V_{DD}$ and the transistors 251, 253 and 290. The transistor 253 has a gate that is coupled to the transistor 251, a drain that is coupled to the resistor 283 the transistors 280, 290, and a source that is coupled to the voltage source $V_{DD}$ and the transistors 251, 252, 290. The transistor 260 has a gate that is coupled to a non-inverting input terminal of the amplifier, a drain that is coupled to the transistors 265 and 275, and a source that is coupled to the transistors 252, 270. The transistor 270 has a gate that is coupled to an inverting input terminal of the amplifier, a drain that is coupled to the transistors 275, 280 and the capacitor 281, and a source that is coupled to the transistor 252. The transistor 265 has a gate that is coupled to the transistors 275 and 260, a drain that is coupled to the transistor 260, and a source that is coupled to the ground. The transistor 275 has a gate that is coupled to the transistors 265 and 260, a drain that is coupled to the transistor 280 and the capacitor 281, and a source that is coupled to the ground. The transistor 280 has a gate that is coupled to the transistors 270, 275 and the capacitor 281, a drain that is coupled to the transistors 253, 290 and the resistor 283, a source that is coupled to the ground. The transistor 290 has a gate that is coupled to the transistors 280, 253 and the resistor 283, a source that is coupled to the voltage source $V_{DD}$ and the transistors 251, 252, 253, and a drain receives the feedback signal $S_D$.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An offline control circuit of LED driver to control a plurality of LEDs, comprising:

a switching circuit generating a plurality of LED currents through a transformer to supply the LEDs;

a voltage divider coupled to the LEDs and sensing a voltage across the LEDs for generating a voltage-feedback signal;

a voltage-feedback circuit coupled to the voltage divider and sensing the voltage-feedback signal for generating a voltage loop signal;

a current-feedback circuit coupled to the LEDs and sensing the LED currents for generating a current loop signal in accordance with a plurality of current-feedback signals of the LEDs, and in response to a maximum current of the LEDs, the current-feedback circuit comprises:

a plurality of operational amplifiers, receiving the current-feedback signals for generating the current loop signal; and a second capacitor coupled from outputs of the operational amplifiers to a ground for frequency compensation;

wherein the operational amplifiers are trans-conductance operational amplifier and are connected each other in parallel; and a buffer circuit coupled to the voltage-feedback circuit and the current-feedback circuit, generating a feedback signal in accordance with the voltage loop signal and the current loop signal;

wherein the feedback signal is coupled to the switching circuit to control a maximum voltage of the LEDs and the maximum current of the LEDs.

2. The offline control circuit of claim 1, wherein the voltage-feedback circuit has a reference voltage comparing with the voltage-feedback signal to generate the voltage loop signal.

3. The offline control circuit of claim 1, wherein the current-feedback circuit has a current threshold comparing with the current-feedback signals to generate the current loop signal.

4. The offline control circuit of claim 1, wherein the voltage divider comprises at least two resistors.

5. The offline control circuit of claim 1, wherein the voltage-feedback circuit comprises:

a first operational amplifier, receiving the voltage-feedback signal for generating the voltage loop signal; and a first capacitor coupled from an output of the first operational amplifier to a ground for frequency compensation;

wherein the first operational amplifier is a trans-conductance operational amplifier.

6. The offline control circuit of claim 1, wherein the buffer circuit comprises two buffer amplifiers connected in parallel and receiving the voltage loop signal and the current loop signal respectively for generating the feedback signal.

7. The offline control circuit of claim 1, wherein the feedback signal is coupled to the switching circuit through an optical-coupler.

8. The offline control circuit of claim 1, wherein the voltage-feedback circuit receives a control signal to control the intensity of LEDs.

9. The offline control circuit of claim 8, wherein a control current is generated in response to the control signal, and the control current is coupled to the voltage divider to control the voltage across the LEDs.

* * * * *